US009874850B2

(12) United States Patent
Tamura et al.

(10) Patent No.: US 9,874,850 B2
(45) Date of Patent: Jan. 23, 2018

(54) IMAGE FORMING APPARATUS WITH COVER CONNECTOR

(71) Applicant: KYOCERA Document Solutions Inc., Osaka-shi, Osaka (JP)

(72) Inventors: Takashi Tamura, Osaka (JP); Nobuhiro Fukuma, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/253,585

(22) Filed: Aug. 31, 2016

(65) Prior Publication Data

US 2017/0068209 A1 Mar. 9, 2017

(30) Foreign Application Priority Data

Sep. 4, 2015 (JP) ..... 2015-174423

(51) Int. Cl.
*G03G 21/16* (2006.01)

(52) U.S. Cl.
CPC ..... *G03G 21/1633* (2013.01)

(58) Field of Classification Search
None
See application file for complete search history.

(56) References Cited

U.S. PATENT DOCUMENTS

2007/0243748 A1* 10/2007 Kuse ..... G03G 21/1652 439/352
2007/0291453 A1* 12/2007 Miller ..... A22B 5/0064 361/728

FOREIGN PATENT DOCUMENTS

JP 04199157 A * 7/1992
JP 2003295553 A 10/2003

OTHER PUBLICATIONS

JP_04199157_A_T Machine Translation Goino, Japan.*

* cited by examiner

*Primary Examiner* — Victor Verbitsky
(74) *Attorney, Agent, or Firm* — Alleman Hall Creasman & Tuttle LLP

(57) ABSTRACT

An image forming apparatus includes an exterior cover, a connector, and an upper exterior member disposed above the exterior cover. The upper exterior member includes a groove portion and projections. In the upper exterior member, the groove portion is formed so as to extend from a first end closer to the connector to a second end closer to one of left and right side ends of the exterior cover. The projections are formed so as to project upward from a lower edge portion of an opening of the groove portion. A cable connected to the connector is inserted in the groove portion. The projections prevent the cable from being dropped from the groove portion.

4 Claims, 4 Drawing Sheets

IMAGE FORMING APPARATUS WITH COVER CONNECTOR

INCORPORATION BY REFERENCE

This application is based upon and claims the benefit of priority from the corresponding Japanese Patent Application No. 2015-174423 filed on Sep. 4, 2015, the entire contents of which are incorporated herein by reference.

BACKGROUND

The present disclosure relates to an image forming apparatus.

It is known that, in an image forming apparatus, a connector is typically disposed in a rear surface or side surface of a main body of the apparatus. A cable, such as a communication cable, connected to the connector hangs downward from the connector.

SUMMARY

An image forming apparatus according to one aspect of the present disclosure includes an exterior cover, a connector, and an upper exterior member. The exterior cover is a member that is configured to cover an opening in a rear surface or a side surface of a main body of the apparatus, and is attached to the main body of the apparatus such that the opening is openable. The connector is disposed above the exterior cover. The upper exterior member is configured to form an exterior of the main body of the apparatus above the exterior cover, and includes a groove portion and projections. The groove portion is formed so as to extend from a first end closer to the connector to a second end closer to one of left and right side ends of the exterior cover. The projections are formed so as to project upward from a lower edge portion of an opening of the groove portion at least at a position closer to the first end of the groove portion and at a position closer to the second end of the groove portion. In the groove portion, a cable connected to the connector is inserted. The projections prevent the cable from being dropped from the groove portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
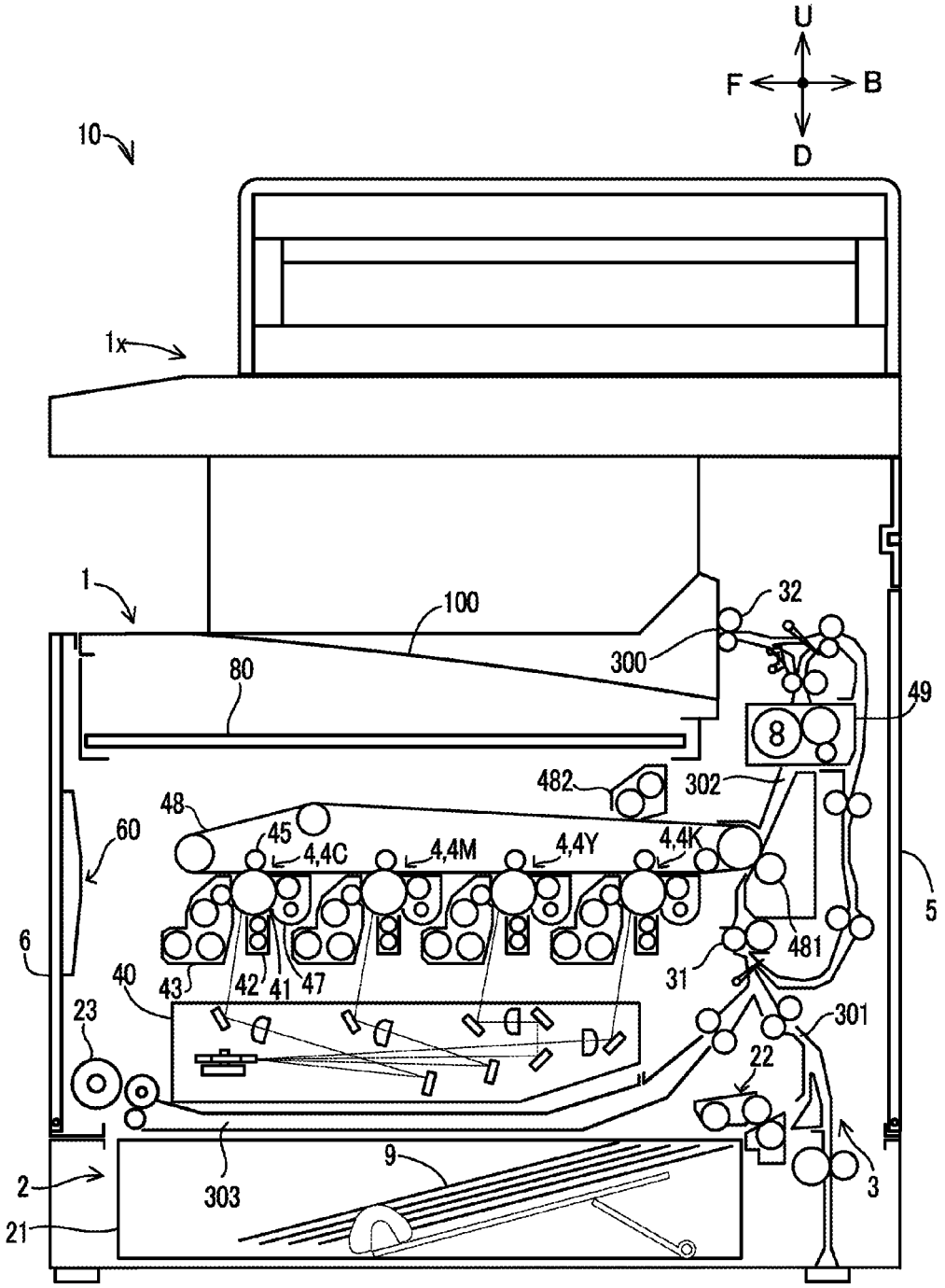
FIG. 1 illustrates a configuration of an image forming apparatus according to an embodiment.

Hereinafter, embodiments of the present disclosure will be described with reference to the accompanying drawings. The following embodiments are examples where the present disclosure is embodied, and, by nature, do not limit the technical scope of the present disclosure.

[Schematic Configuration of Image Forming Apparatus 10]

Firstly, with reference to FIG. 1, the schematic configuration of an image forming apparatus 10 according to an embodiment will be described.

The image forming apparatus 10 is an electrophotographic type image forming apparatus that forms an image on a sheet material 9. The sheet material 9 is a sheet-like image formation medium, such as paper, coated paper, a postcard, an envelope, or an OHP sheet.

The image forming apparatus 10 includes a main body 1 of the apparatus, a sheet supply portion 2, and a scanner 1*x*. Further, the image forming apparatus 10 includes a sheet conveying portion 3, developing units 4, a laser scanning portion 40, a fixing device 49, a control board 80, and the like in the main body 1.

The scanner 1*x* is a device that reads an image from a document and outputs data of the image of the document. The image forming apparatus 10 is capable of performing a copying job and a facsimile transmission job by operation of the scanner 1*x*.

In the copying job, the scanner 1*x* reads the image from the document, and devices in the main body 1 form, on the sheet material 9, an image based on the data of the image of the document obtained by the scanner 1*x*.

In the facsimile transmission job, the scanner 1*x* reads the image from the document, and a communication interface mounted on the control board 80 in the main body 1 transmits the data of the image of the document obtained by the scanner 1*x* to another apparatus via a public communication line.

In addition, the image forming apparatus 10 is capable of performing a facsimile reception job. In the facsimile reception job, the communication interface receives image data via the public communication line, and devices such as the developing units 4 form an image based on the received data on the sheet material 9.

The image forming apparatus 10 illustrated in FIG. 1 is a tandem-type image forming apparatus, and is also a color printer. Accordingly, the image forming apparatus 10 includes a plurality of developing units 4 for colors of cyan, magenta, yellow, and black.

Each developing unit 4 includes a photosensitive member 41, a charging device 42, a developing device 43, a primary transfer device 45, a primary cleaning device 47, and the like.

The image forming apparatus 10, which is a tandem-type image forming apparatus, further includes an intermediate transfer belt 48, a secondary transfer device 481, and a secondary cleaning device 482.

The sheet supply portion 2 includes a sheet cassette 21, a first sheet feed portion 22, and a second sheet feed portion 23. The sheet cassette 21 is a portion in which a plurality of sheet materials 9 are stacked and stored. The first sheet feed portion 22 feeds the sheet material 9 from the sheet cassette 21 to a first conveying path 301. The second sheet feed portion 23 feeds the sheet material 9 placed on a manual sheet feed tray 60, which will be described below, to a third conveying path 303.

The sheet conveying portion 3 includes a conveying roller 31 and a discharge roller 32. The conveying roller 31 conveys, from the first conveying path 301 to a second conveying path 302, the sheet material 9 fed from the sheet supply portion 2. In addition, the conveying roller 31 conveys, from the third conveying path 303 to the first conveying path 301, the sheet material 9 fed from the manual sheet feed tray 60.

The discharge roller 32 discharges the sheet material 9 conveyed along the second conveying path 302 onto a discharge tray 100 through a sheet discharge outlet 300. The sheet material 9 discharged onto the discharge tray 100 is typically a sheet material 9 on which an image has been formed, that is, a printed object.

The intermediate transfer belt 48 is a belt-shaped member formed into an annular shape. The intermediate transfer belt 48 is wound around two rollers, and rotated.

In each developing unit 4, the photosensitive member 41, which is in the shape of a drum, rotates, and a surface of the photosensitive member 41 is uniformly charged by the charging device 42. An electrostatic latent image is written on the surface of the photosensitive member 41 by scanning with laser light by the laser scanning portion 40. The developing device 43 develops the electrostatic latent image on the surface of the photosensitive member 41 with toner. As a result, a toner image is formed on the surface of the photosensitive member 41.

The primary transfer device 45 transfers the toner image from the surface of the photosensitive member 41 to the intermediate transfer belt 48. The toner image is transferred from each of the plurality of the photosensitive members 41 to the intermediate transfer belt 48. As a result, a color image in which the toner images of the respective colors are superimposed on each other is formed on the intermediate transfer belt 48. The primary cleaning device 47 removes the toner which remains on the surface of the photosensitive member 41.

The secondary transfer device 481 transfers the color image formed on the intermediate transfer belt 48, to the sheet material 9, in the second conveying path 302. The secondary cleaning device 482 removes the toner which remains on the intermediate transfer belt 48.

The fixing device 49 heats the sheet material 9 to fix the color image onto the sheet material 9, in the second conveying path 302.

The control board 80 is a board on which electronic components for control of the image forming apparatus 10 are mounted. The control board 80 is disposed between the discharge tray 100 and the developing units 4.

Figure 2:
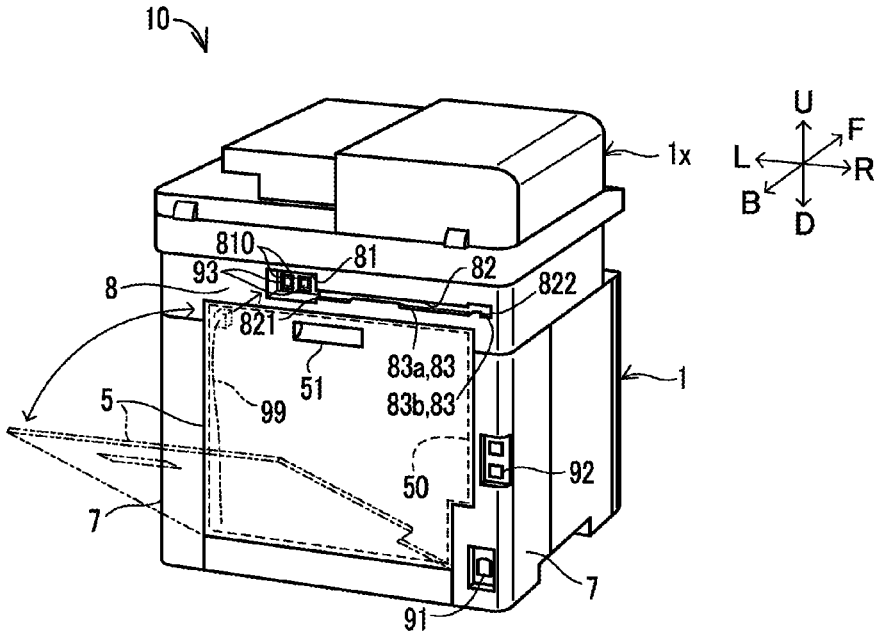
FIG. 2 is a perspective view of the image forming apparatus according to the embodiment.

As illustrated in FIG. 2, the image forming apparatus 10 further includes a power supply connector 91, a LAN connector 92, a telephone line connector 93, and the like. A power supply cable is connected to the power supply connector 91, and a LAN cable is connected to the LAN connector 92.

In addition, a telephone cable 99 is connected to the telephone line connector 93. In FIG. 2, the telephone cable 99 is represented by an imaginary line. The telephone cable 99 is a communication cable used for the facsimile communication.

Directional arrows F, B, U, and D shown in the drawings indicate: a frontward direction F, which is a direction from the rear of the main body 1 toward the front thereof; a rearward direction B, which is a direction from the front of the main body 1 toward the rear thereof, an upward direction U; and a downward direction D, respectively. In the present embodiment, the sheet material 9 is discharged in the frontward direction F.

In addition, directional arrows R and L shown in the drawings indicate a rightward direction R and a leftward direction L, respectively, when viewed from the rear side of the main body 1.

Exterior members of the image forming apparatus 10 include a front exterior cover 6, a rear exterior cover 5, corner exterior members 7, an upper exterior member 8, and the like (see FIGS. 1 and 2). The rear exterior cover 5 forms an exterior between the two corner exterior members 7 on the rear side of the main body 1.

The front exterior cover 6 is supported so as to be pivotable about a lower portion of the main body 1. The front exterior cover 6 is tilted outward from the main body 1 to form the manual sheet feed tray 60 (see FIG. 1).

Each corner exterior member 7 forms an exterior of a corner portion in the side portion of the main body 1. In the present embodiment, each of the power supply connector 91 and the LAN connector 92 is installed in a rear-side portion of the corner exterior member 7.

The rear exterior cover 5 is an exterior member that covers an opening 50 in the rear surface of the main body 1. The rear exterior cover 5 is attached such that the opening 50 can be opened relative to the main body 1. In the present embodiment, the opening 50, which is closed by the rear exterior cover 5, is an opening that is in communication with both the first conveying path 301 and the second conveying path 302 in which the sheet material 9 is conveyed (see FIG. 1).

More specifically, the rear exterior cover 5 is supported so as to be pivotable outward of the main body 1. For example, the rear exterior cover 5 is supported so as to be pivotable about a lower portion of the main body 1. A recessed handle 51 is formed at an upper portion of the rear exterior cover 5.

Each of the front exterior cover 6 and the rear exterior cover 5 is held so as to stand along the main body 1 by a lock mechanism (not shown). The lock mechanism may be formed by, for example, a projection portion and a recessed portion to be fitted to each other. In this case, one of the projection portion and the recessed portion of the lock mechanism is formed in each of the front exterior cover 6 and the rear exterior cover 5, while the other of the projection portion and the recessed portion is formed in the main body 1 or another exterior member, such as the corner exterior member 7, fixed to the main body 1.

The upper exterior member 8 is a member that forms an exterior of the main body 1 above the rear exterior cover 5. The telephone line connector 93 is installed in the upper exterior member 8.

In the image forming apparatus 10, the telephone line connector 93 is disposed above the rear exterior cover 5 in the main body 1 of the apparatus. A connector such as the telephone line connector 93, may be disposed above an exterior cover on the side surface of the main body 1.

Figure 3:
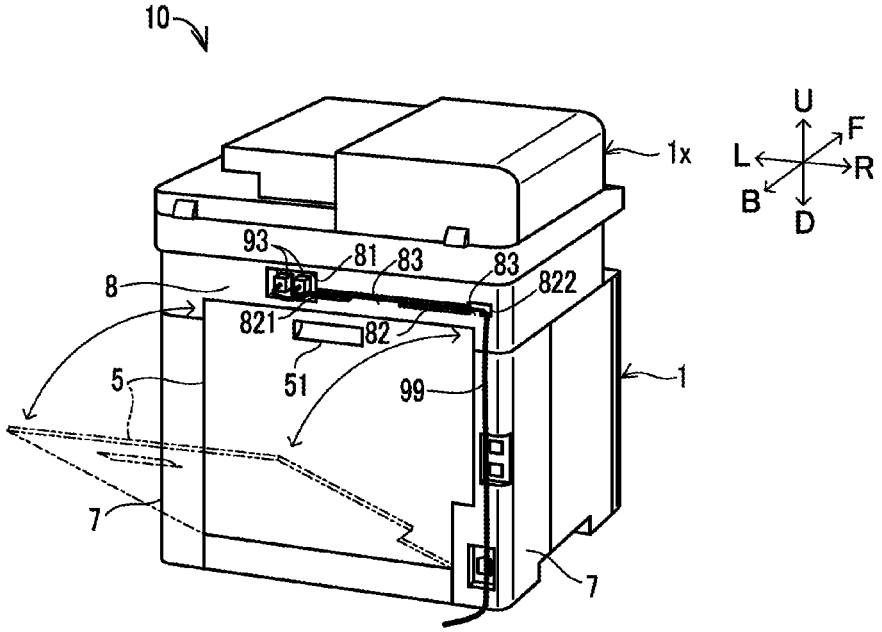
FIG. 3 is a perspective view of the image forming apparatus with a cable connected thereto.

The opening 50 on the rear side is opened when the rear exterior cover 5 is turned outward from the main body 1. In FIGS. 2 and 3, the rear exterior cover 5 that opens the opening 50 is represented by imaginary lines. The rear exterior cover 5 is opened when, for example, jamming has occurred.

As in the present embodiment, in the case where a connector such as the telephone line connector 93, is disposed above an exterior cover in the main body 1, a cable such as the telephone cable 99, may hang downward from the connector to hinder closing and opening of the exterior cover. The connector or the cable may be damaged if the cable is caught by the exterior cover.

A hook for catching the cable may be provided above the exterior cover in an exterior member of the image forming apparatus. In this case, the cable is guided by the hook to a portion to one of the right or the left of the exterior cover.

However, the hook projects outward from the main body 1, and may become an obstacle for an operator. Moreover, the hook may be easily damaged by contact with the operator or a peripheral member.

The image forming apparatus 10 has a cable holding structure which is not easily damaged and can prevent, by using the cable holding structure, the telephone cable 99 connected to the telephone line connector 93 from being caught by the rear exterior cover 5. The details thereof will be described below.

[Cable Holding Structure]

The cable holding structure is provided in the upper exterior member 8. The upper exterior member 8 includes a recessed portion 81, a groove portion 82, and projections 83.

Figure 4:
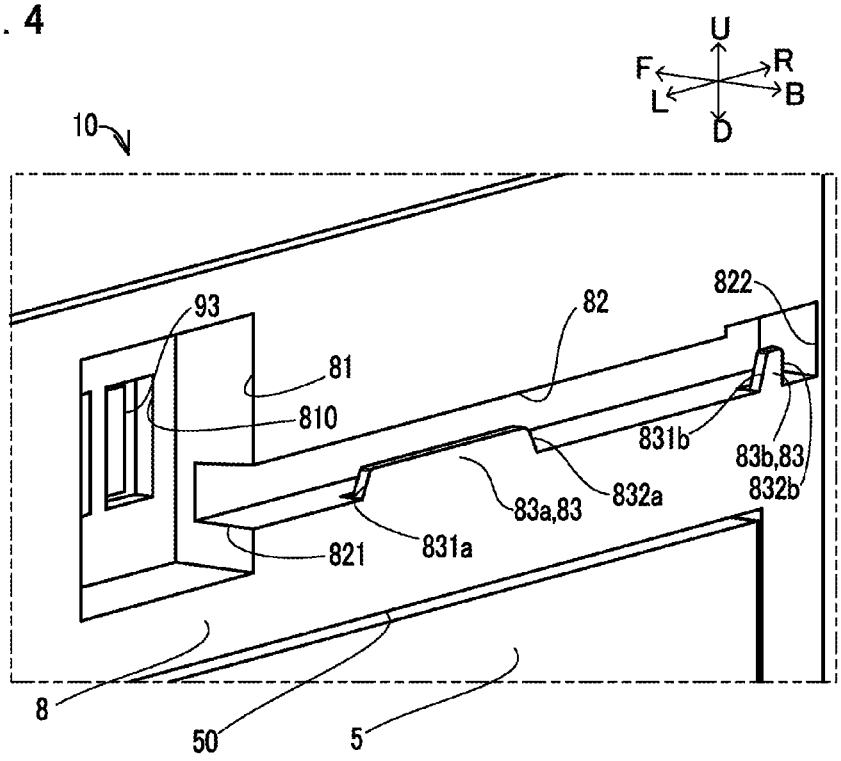
FIG. 4 is a perspective view of an upper exterior member of the image forming apparatus according to the embodiment.

As illustrated in FIGS. 2 and 4, the recessed portion 81 is a portion in which the telephone line connector 93 is installed. The telephone line connector 93 is disposed in an opening 810 formed in the bottom of the recessed portion 81.

The groove portion 82 is formed so as to extend from a first end 821 to a second end 822 along a lateral direction. The first end 821 of the groove portion 82 is positioned closer to the telephone line connector 93. The second end 822 of the groove portion 82 is positioned closer to one of left and right side ends of the rear exterior cover 5.

In the present embodiment, the second end 822 of the groove portion 82 is positioned outward of and above a right side end 5*e* of the rear exterior cover 5 when viewed from the rear side of the main body 1. The groove portion 82 is a portion in which the telephone cable 99 connected to the telephone line connector 93 is inserted.

Each projection 83 is a portion which projects upward from a lower edge portion of an opening of the groove portion 82. The projections 83 are formed at least at a position closer to the first end 821 of the groove portion 82 and at a position closer to the second end 822 of the groove portion 82.

The second end 822 of the groove portion 82 may be positioned outward of and above a left side end of the rear exterior cover 5 when viewed from the rear side of the main body 1. The groove portion 82 may be formed so as to extend from a position closer to the telephone line connector 93 to a position closer to one of the left and right side ends of the rear exterior cover 5.

In the present embodiment, the projections 83 include a first projection 83*a* and a second projection 83*b*. That is, the plurality of projections 83*a* and 83*b* are formed so as to be spaced from each other in a longitudinal direction of the groove portion 82. The first projection 83*a* is formed at a position closer to the first end 821 of the groove portion 82. The second projection 83*b* is formed at a position closer to the second end 822 of the groove portion 82.

Each projection 83 is a portion that prevents the telephone cable 99 from being dropped from the groove portion 82. The telephone cable 99 inserted in the groove portion 82 is caught by each projection 83 and is thus held in the groove portion 82.

Figure 6:
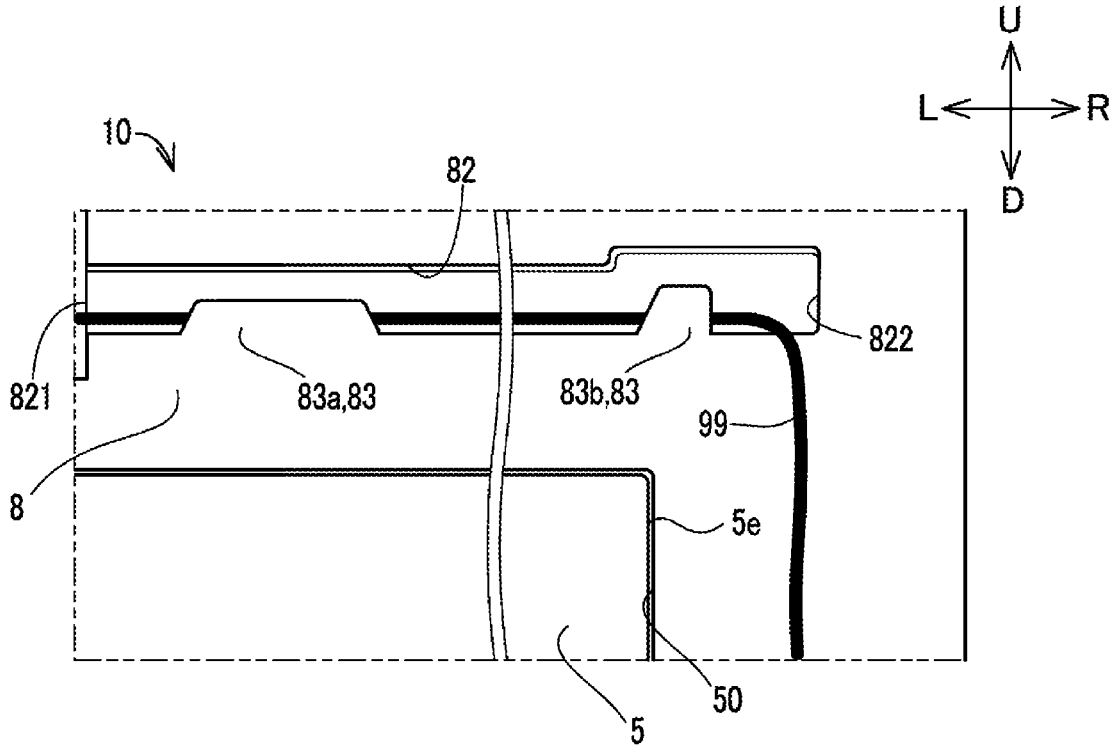
FIG. 6 is a front view of the upper exterior member of the image forming apparatus with a cable connected thereto.

As illustrated in FIGS. 3 and 6, an end portion of the telephone cable 99 is connected to the telephone line connector 93, and a portion of the remaining portion of the telephone cable 99 is inserted in the groove portion 82. The telephone cable 99 is guided by the groove portion 82 and the projections 83 from the position of the telephone line connector 93 to one of side portions of the rear exterior cover 5.

Accordingly, when the groove portion 82 and the projections 83 are used, the telephone cable 99 connected to the telephone line connector 93 can be prevented from being caught by the rear exterior cover 5. Moreover, the groove portion 82 and the projections 83 do not have portions that project outward from the upper exterior member 8. Thus, the groove portion 82 and the projections 83 are not easily damaged, and do not become an obstacle for an operator.

In the upper exterior member 8, the recessed portion 81 is in communication with the first end 821 of the groove portion 82. Further, the recessed portion 81 is recessed more greatly than the groove portion 82. Thus, in a portion above the rear exterior cover 5, the telephone cable 99 does not protrude from the rear surface of the main body 1, or the height of protrusion of the telephone cable 99 from the rear surface of the main body 1 is reduced. As a result, the telephone cable 99 is less likely to become an obstacle for an operator.

Figure 5:
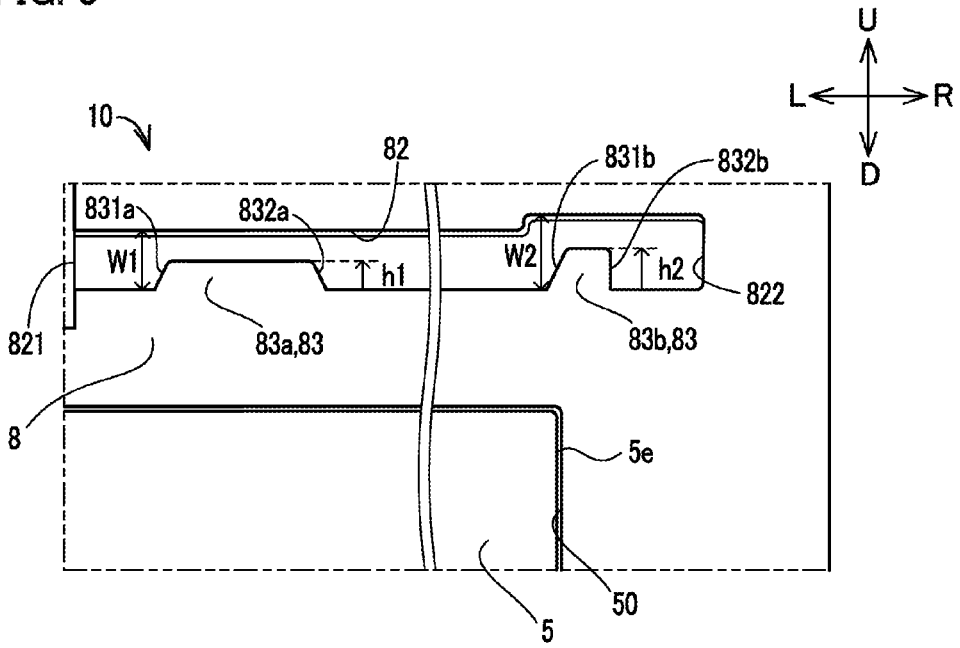
FIG. 5 is a front view of the upper exterior member of the image forming apparatus according to the embodiment.

As illustrated in FIG. 5, an edge portion of the first projection 83*a* on the side closer to the first end 821 of the groove portion 82 forms a slant surface 831*a*. The slant surface 831*a* extends from the base side toward the top side of the first projection 83*a* so as to be slant relative to the vertical direction toward the second end 822 of the groove portion 82.

Similarly, an edge portion of the second projection 83*b* on the side closer to the first end 821 of the groove portion 82 also forms a slant surface 831*b*. The slant surface 831*b* also extends from the base side toward the top side of the second projection 83*b* so as to be slant relative to the vertical direction toward the second end 822 of the groove portion 82.

When the telephone cable 99 is pushed into the groove portion 82, the slant surfaces 831*a* and 831*b* guide the telephone cable 99 into a portion where the width of the opening of the groove portion 82 is reduced due to the projections 83. This facilitates an operation of inserting the telephone cable 99 into the groove portion 82.

In addition, an edge portion of the first projection 83*a* on the side closer to the second end 822 of the groove portion 82 also forms a slant surface 832*a*. When the telephone cable 99 is extracted from the groove portion 82, the slant surface 832*a* guides the telephone cable 99 into a portion where the width of the opening of the groove portion 82 is reduced due to the first projection 83*a*. This facilitates an operation of extracting the telephone cable 99 from the groove portion 82.

Meanwhile, an edge portion of the second projection 83*b* on the side closer to the second end 822 of the groove portion 82 forms a vertical surface 832*b* that extends along the vertical direction. Thus, the telephone cable 99 is less likely to be dropped from the groove portion 82 even if the telephone cable 90 is pulled. The vertical surface 832*b* is an edge portion, of the projections 83, which is closest to the second end 822 of the groove portion 82.

The edge portion of the second projection 83*b* on the side closer to the second end 822 of the groove portion 82 may extend from the base side toward the top side of the second projection 83*b* so as to be slant relative to the vertical direction toward the second end 822 of the groove portion 82. In this case, dropping of the telephone cable 99 from the groove portion 82 is further reduced.

In the present embodiment, a height h2 of the second projection 83*b* from the base to the top thereof is greater than a height h1 of the first projection 83*a* from the base to the top thereof (see FIG. 5). In other words, the height of the second projection 83*b*, which is closest to the second end 822 of the groove portion 82 among all the plurality of projections 83, is greater than the height of any other projection 83. Thus, dropping of the telephone cable 99 from the groove portion 82 is further reduced.

Further, a portion of the opening of the groove portion 82 where the second projection 83*b* is provided has a width W2 greater than a width W1 of a portion of the opening of the groove portion 82 where the first projection 83*a* is provided. In other words, the width W2 of the portion of the opening of the groove portion 82 where the second projection 83*b* having a great height is provided is greater than the width W1 of any other portion of the opening for the plurality of projections 83 in the groove portion 82.

This makes it easy to insert the telephone cable 99 into the groove portion 82 and remove the telephone cable 99 from the groove portion 82 even in the portion at which the second projection 83*b* having a great height is provided.

[Application Example]

In the upper exterior member 8 of the image forming apparatus 10, a projection 83 may be formed so as to extend continuously from a position closer to the first end 821 of the groove portion 82 to a position closer to the second end 822 of the groove portion 82.

Also, in the upper exterior member 8 of the image forming apparatus 10, three or more projections 83 may be provided so as to be spaced from each other along the longitudinal direction of the groove portion 82.

Also, in the image forming apparatus 10, the LAN connector 92 may be disposed at the position of the telephone line connector 93. In this case, a LAN cable (not shown) connected to the LAN connector 92 is inserted in the groove portion 82.

Also, in the image forming apparatus 10, both the LAN connector 92 and the telephone line connector 93 may be disposed above the rear exterior cover 5. In this case, both the LAN cable and the telephone cable 99 are inserted in the groove portion 82.

Also, in the image forming apparatus 10, an exterior cover corresponding to the rear exterior cover 5 may be disposed on the side surface of the main body 1. Further, a connector, e.g., the telephone line connector 93, may be disposed above the exterior cover on the side surface. In this case, the upper exterior member 8 including the groove portion 82 and the projections 83, is disposed above the exterior cover on the side surface.

Also, the rear exterior cover 5 or the exterior cover, on the side surface, corresponding thereto may be an exterior member that covers an opening formed for a component for consumable in the main body 1. The component for the consumable may be, for example, a toner container in which toner is stored.

The image forming apparatus according to the present disclosure can be configured by freely combining the embodiments and application examples described above, or modifying or partially omitting the embodiments and the application examples as appropriate, within the scope of the disclosure recited in each claim.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an exterior cover configured to cover an opening in a rear surface or a side surface of a main body of the apparatus, the exterior cover attached to the main body of the apparatus such that the opening is openable;

a connector disposed above the exterior cover; and an upper exterior member configured to form an exterior of the main body of the apparatus above the exterior cover, wherein the upper exterior member includes:

a groove portion formed so as to extend from a first end closer to the connector to a second end closer to one of left and right side ends of the exterior cover, wherein the second end of the groove portion is positioned outward of and above one of the left and right side ends of the exterior cover; and projections formed so as to project upward from a lower edge portion of an opening of the groove portion at least at a position closer to the first end of the groove portion and at a position closer to the second end of the groove portion, in the groove portion, a cable connected to the connector is inserted, and the projections prevent the cable from being dropped from the groove portion.

2. An image forming apparatus comprising:

an exterior cover configured to cover an opening in a rear surface or a side surface of a main body of the apparatus, the exterior cover attached to the main body of the apparatus such that the opening is openable;

a connector disposed above the exterior cover; and an upper exterior member configured to form an exterior of the main body of the apparatus above the exterior cover, wherein the upper exterior member includes:

a groove portion formed so as to extend from a first end closer to the connector to a second end closer to one of left and right side ends of the exterior cover; and projections formed so as to project upward from a lower edge portion of an opening of the groove portion at least at a position closer to the first end of the groove portion and at a position closer to the second end of the groove portion, in the groove portion, a cable connected to the connector is inserted, the projections prevent the cable from being dropped from the groove portion, and an edge portion, of each projection, closer to the first end of the groove portion is formed so as to be slanted toward the second end of the groove portion relative to a vertical direction from a base side to a top side thereof.

3. An image forming apparatus comprising:

an exterior cover configured to cover an opening in a rear surface or a side surface of a main body of the apparatus, the exterior cover attached to the main body of the apparatus such that the opening is openable;

a connector disposed above the exterior cover; and an upper exterior member configured to form an exterior of the main body of the apparatus above the exterior cover, wherein the upper exterior member includes:

a groove portion formed so as to extend from a first end closer to the connector to a second end closer to one of left and right side ends of the exterior cover; and projections formed so as to project upward from a lower edge portion of an opening of the groove portion at least at a position closer to the first end of the groove portion and at a position closer to the second end of the groove portion, in the groove portion, a cable connected to the connector is inserted, the projections prevent the cable from being dropped from the groove portion, the upper exterior member includes a recessed portion formed so as to be in communication with the first end of the groove portion, and be recessed deeper than the groove portion, and the connector is installed in an opening formed in a bottom of the recessed portion.

4. An image forming apparatus comprising:

an exterior cover configured to cover an opening in a rear surface or a side surface of a main body of the apparatus, the exterior cover attached to the main body of the apparatus such that the opening is openable;

a connector disposed above the exterior cover; and an upper exterior member configured to form an exterior of the main body of the apparatus above the exterior cover, wherein the upper exterior member includes:

a groove portion formed so as to extend from a first end closer to the connector to a second end closer to one of left and right side ends of the exterior cover; and projections formed so as to project upward from a lower edge portion of an opening of the groove portion at least at a position closer to the first end of the groove portion and at a position closer to the second end of the groove portion, in the groove portion, a cable connected to the connector is inserted, the projections prevent the cable from being dropped from the groove portion, a plurality of the projections are formed so as to be spaced from each other along a longitudinal direction of the groove portion, one of the projections which is closest to the second end of the groove portion has a height greater than a height of any other projections, and a portion of the opening of the groove portion where the one of the projections which is closest to the second end is provided has a width greater than a width of a remaining portion of the opening of the groove portion.

* * * * *